US006055920A

United States Patent [19]

Hori

[11] Patent Number: 6,055,920

[45] Date of Patent: May 2, 2000

[54] SEWING MACHINE WITH BOTH NEEDLE BAR ROCKING AND THREAD TENSION RELEASING MECHANISMS ACTUATED BY SINGLE ACTUATOR

[75] Inventor: Takeyoshi Hori, Yokkaichi, Japan

[73] Assignee: Brother Kogyo Kabushiki Kaisha, Nagoya, Japan

[21] Appl. No.: 09/081,201

[22] Filed: May 19, 1998

[30] Foreign Application Priority Data

May 22, 1997 [JP] Japan ..... 9-150224

[51] Int. Cl.[7] ..... D05B 03/00; D05B 47/04

[52] U.S. Cl. ..... 112/443; 112/254

[58] Field of Search ..... 112/443, 448, 112/220, 221, 254

[56] References Cited

U.S. PATENT DOCUMENTS 2,609,772 9/1952 Casas-Robert ..... 112/254

4,858,548 8/1989 Echeverria ..... 112/221

FOREIGN PATENT DOCUMENTS 1320086 12/1989 Japan ..... 112/254

6031076 2/1994 Japan ..... 112/254

1254077 8/1986 Russian Federation ..... 112/254

*Primary Examiner*—Ismael Izaguirre

*Attorney, Agent, or Firm*—Oliff & Berridge, PLC

[57] ABSTRACT

A sewing machine includes a needle bar rocking mechanism for rocking a needle bar in a direction crossing a direction in which a workpiece cloth to be sewn is fed, a thread tension applying mechanism for applying tension to a needle thread supplied from a needle thread supply to a sewing needle mounted on the needle bar, a thread tension releasing mechanism operating the thread tension applying mechanism so that the needle thread is released from the tension applied to it by the thread tension applying mechanism, and a single rotary actuator for driving both of the needle bar rocking mechanism and the thread tension releasing mechanism.

20 Claims, 9 Drawing Sheets

SEWING MACHINE WITH BOTH NEEDLE BAR ROCKING AND THREAD TENSION RELEASING MECHANISMS ACTUATED BY SINGLE ACTUATOR

BACKGROUND OF THE INVENTION

1. Field of the Invention

This invention relates to a sewing machine provided with a needle bar rocking mechanism for rocking a needle bar leftward and rightward and a thread tension releasing mechanism for releasing a needle thread from tension applied thereto by a thread tension applying mechanism.

2. Description of the Related Art

Household sewing machines comprise a sewing arm including a head provided with a needle bar rocking mechanism, a thread tension applying mechanism and a thread tension releasing mechanism for releasing a needle thread from tension applied thereto by the thread tension applying mechanism. The needle bar rocking mechanism rocks a needle bar in a direction crossing the direction (e.g., forward and backward) in which a workpiece cloth is fed, for example, leftward and rightward. The needle bar rocking mechanism comprises an actuator composed of a stepping motor etc. The needle bar is rocked leftward and rightward by the actuator together with a needle bar bracket mounted on a shaft directed forward and backward, so that various types of stitches such as a zigzag stitch are formed on the workpiece cloth.

The thread tension applying mechanism applies tension to a needle thread supplied from a bobbin serving as a thread supply to be caused to pass through the eye of a sewing needle mounted on a lower end of the needle bar. The thread tension applying mechanism comprises a pair of oppositely disposed thread tension discs or fixed and movable thread tension discs, and a spring for urging the movable thread tension disc toward the fixed thread tension disc. The needle thread supplied from the bobbin via a needle thread take-up lever to the sewing needle is en route held between the fixed disc and the movable disc urged by the spring to be pressed against the fixed disc, so that tension is applied to the needle thread.

The thread tension releasing mechanism comprises an actuator, such as a solenoid actuator, for moving the movable thread tension disc away from the fixed thread tension disc. The movable disc is parted from the fixed disc so that the needle thread is released from the tension.

In the above-described conventional sewing machine, the needle bar rocking mechanism and the thread tension releasing mechanism require individual actuators respectively. This increases the manufacturing cost of the sewing machine and the size of the sewing machine head provided with the needle bar rocking mechanism, the thread tension applying mechanism and the thread tension releasing mechanism.

SUMMARY OF THE INVENTION

Therefore, an object of the present invention is to provide a sewing machine in which the number of actuators can be decreased for reduction in the manufacturing cost thereof and the size of the head thereof can be reduced.

The present invention provides a sewing machine comprising a needle bar rocking mechanism for rocking a needle bar in a direction crossing a direction in which a workpiece cloth to be sewn is fed, a thread tension applying mechanism for applying tension to a needle thread supplied from a needle thread supply to a sewing needle mounted on the needle bar, a thread tension releasing mechanism operating the thread tension applying mechanism so that the needle thread is released from the tension applied thereto by the thread tension applying mechanism, and a single rotary actuator for driving both of the needle bar rocking mechanism and the thread tension releasing mechanism.

According to the above-described construction, both the thread tension releasing and the the needle bar rocking mechanisms are driven by the single rotary actuator. Consequently, the manufacturing cost of the sewing machine and the size of the head thereof can be reduced.

In a preferred form, the rotary actuator is operated in a set range of needle bar rocking operation when operated to drive the needle bar rocking mechanism, and when operated outside the set range of needle bar rocking, the rotary actuator drives the thread tension releasing mechanism so that the thread tension applying mechanism is operated to release the needle thread from the tension.

In another preferred form, the thread tension applying mechanism includes a fixed thread tension disc and a movable thread tension disc moved to come close to and depart from the fixed thread tension disc. The thread tension releasing mechanism includes a driving gear secured to an output shaft of the rotary actuator, a driven gear meshed with the driving gear, a cam provided in a coaxial relation with the driven gear, a rocking lever driven following the cam, and an operating member operated in subjection to a driving force of the rocking lever to thereby move the movable thread tension disc of the thread tension applying mechanism so that the movable thread tension disc departs from the fixed thread tension disc, thereby releasing the needle thread from the tension applied thereto by the thread tension applying mechanism.

In further another preferred form, the rotary actuator comprises a stepping motor, and the driven gear has a stopper member formed integrally therewith, the stopper member being abutted against a stationary member of the machine so that a home position of the stepping motor is set. Furthermore, the stationary member is a shaft formed on the cam.

In further another preferred form, the stepping motor is rotated so that a rotational position thereof is in one of two ranges at opposite sides of and outside the set range of needle bar rocking operation, whereby the home position of the stepping motor is set, and the stepping motor is rotated so that the rotational position thereof is in the other range outside the set range of needle bar rocking operation, whereby the thread tension releasing mechanism is driven to operate the thread tension applying mechanism so that the needle thread is released from the tension applied thereto by the thread tension applying mechanism.

In further another preferred form, when the workpiece cloth is moved a predetermined amount or more, the thread tension releasing mechanism is driven to operate the thread tension applying mechanism so that the needle thread is released from the tension applied thereto by the thread tension applying mechanism.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
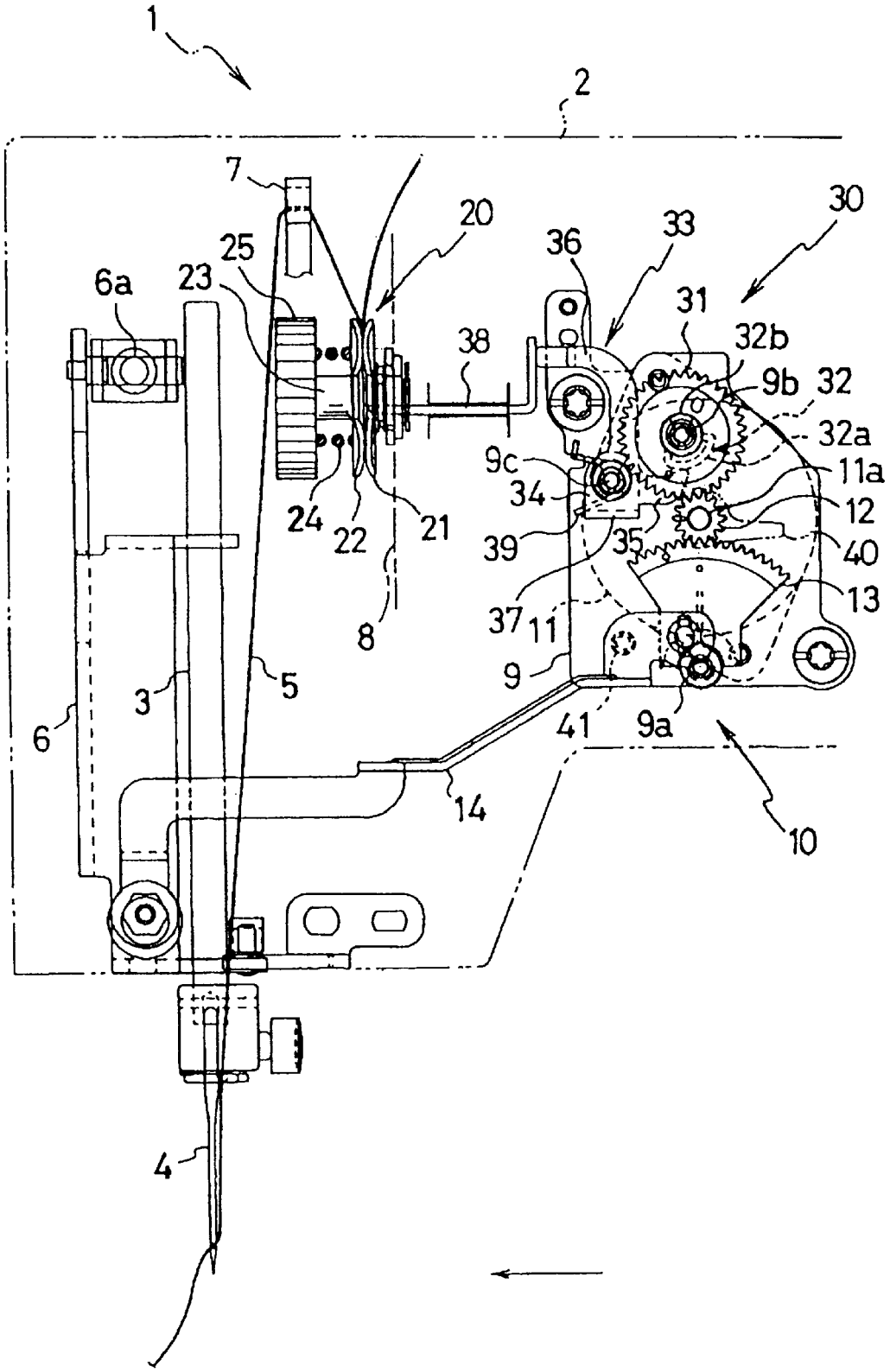
FIG. 1 is a front view of the head of a household sewing machine of a first embodiment in accordance with the present invention, showing the needle bar assuming the central needle position.

A first embodiment of the present invention will be described with reference to FIGS. 1 to 6. The invention is applied to a household sewing machine in the first embodiment. Referring to FIG. 1, a head 2 of the sewing machine 1 is shown. The head 2 is provided with a needle bar rocking mechanism 10, a thread tension applying mechanism 20, and a thread tension releasing mechanism 30 for releasing the thread tension applying mechanism 20. The needle bar rocking mechanism 10 is provided for rocking a needle bar 3 in a direction (leftward and rightward) crossing a direction (forward and backward) in which a workpiece cloth (not shown) to be sewn is fed. The thread tension applying mechanism 20 is provided for applying a predetermined tension to a needle thread 5 supplied from a bobbin (not shown) or a thread supply to a sewing needle 4 mounted on a lower end of the needle bar 3. The thread tension releasing mechanism 30 is provided for operating the thread tension applying mechanism 20 so that the needle thread 5 is released from the tension.

The needle bar rocking mechanism 10 will be described in detail. The needle bar rocking mechanism 10 comprises a stepping motor 11, a driving gear 12 secured to an output shaft 11*a* of the stepping motor 11, a sector gear 13 meshed with the driving gear 12, and a connecting member 14 having opposite ends secured to the sector gear 13 and a needle bar frame 6 by screws respectively. The stepping motor 11 constitutes a rotary actuator in the invention. The sector gear 13 is formed with gear teeth in a range of about 80 degrees. When the stepping motor 11 of the needle bar rocking mechanism 10 is rotated alternately in the normal and reverse directions, the driving gear 12 and the sector gear 13 are rotated in the normal and reverse directions so that the connecting member 14 is rocked leftward and rightward. The needle bar frame 6 mounted on the shaft 6*a* and linked with the connecting member 14, and accordingly the needle bar 3 mounted on the needle bar frame 6 are rocked leftward and rightward.

Figure 4:
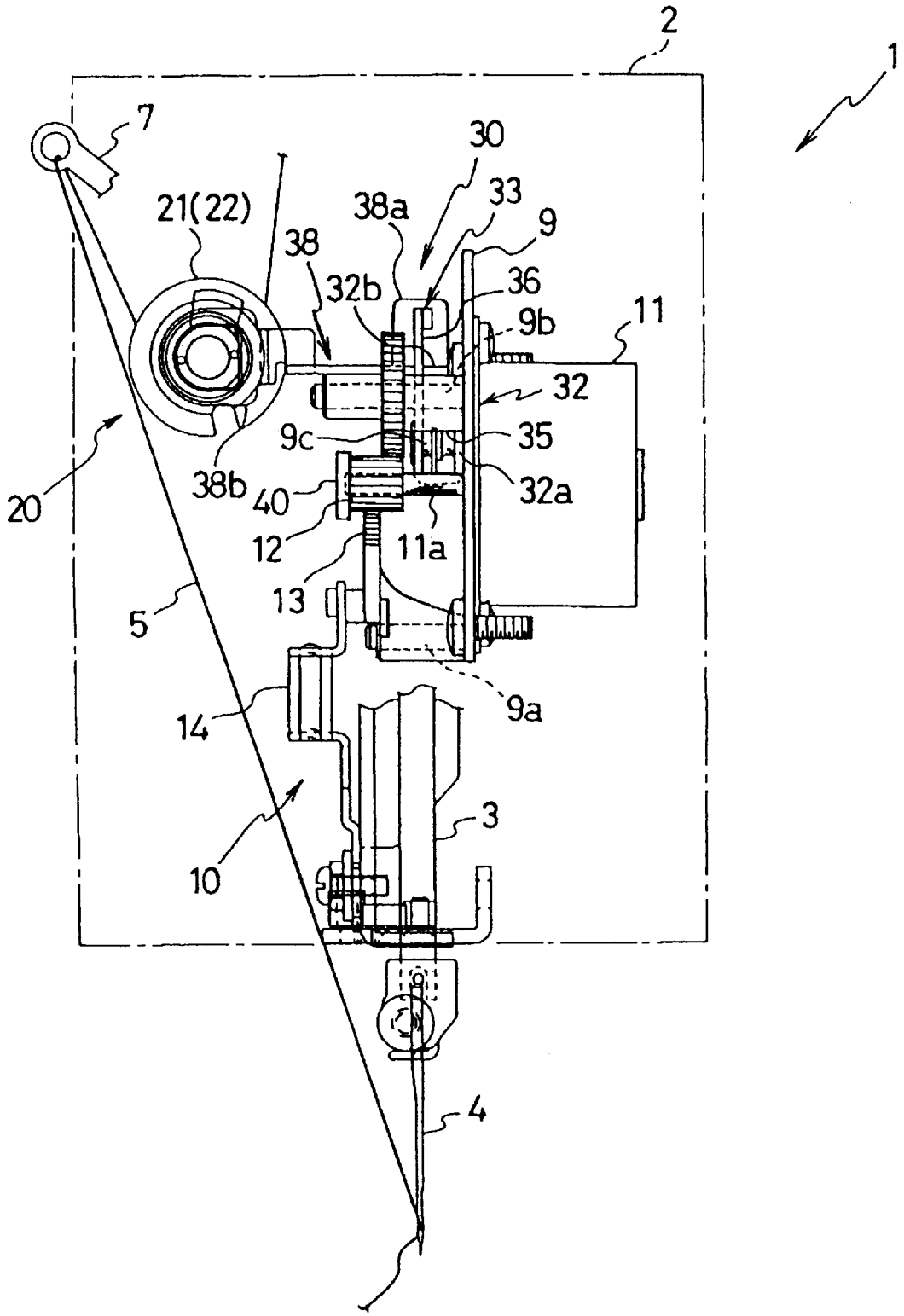
FIG. 4 is a side view of the head of the sewing machine.

More specifically, the stepping motor 11 is fixed on the backside of a board 9, and its output shaft 11*a* extends forward through a hole (not shown) formed in the board 9, as shown in FIG. 4. The driving gear 12 is secured to a distal end of the output shaft 11*a* located in front of the board 9. The sector gear 13 is rotatably mounted on a shaft 9*a* extending forward from the lower end of the board 9. One end of the connecting member 14 is connected to a lower portion of the sector gear 13. The needle bar 3 is guided by the needle bar frame 6 to be reciprocally moved by a needle bar driving mechanism (not shown) in the direction parallel to the frame.

The sector gear 13 is rotated counterclockwise about the shaft 9*a* when the driving gear 12 is rotated clockwise by the stepping motor 11. Upon the counterclockwise rotation of the sector gear 13, the connecting member 14 is moved leftward so that the needle bar frame 6 and the needle bar 3 are rocked leftward about the shaft 6*a*. The sector gear 13 is rotated clockwise about the shaft 9*a* when the driving gear 12 is rotated counterclockwise by the stepping motor 11. As a result, the connecting member 14 is moved rightward so that the needle bar frame 6 and the needle bar 3 are rocked rightward about the shaft 6*a*.

Figure 2:
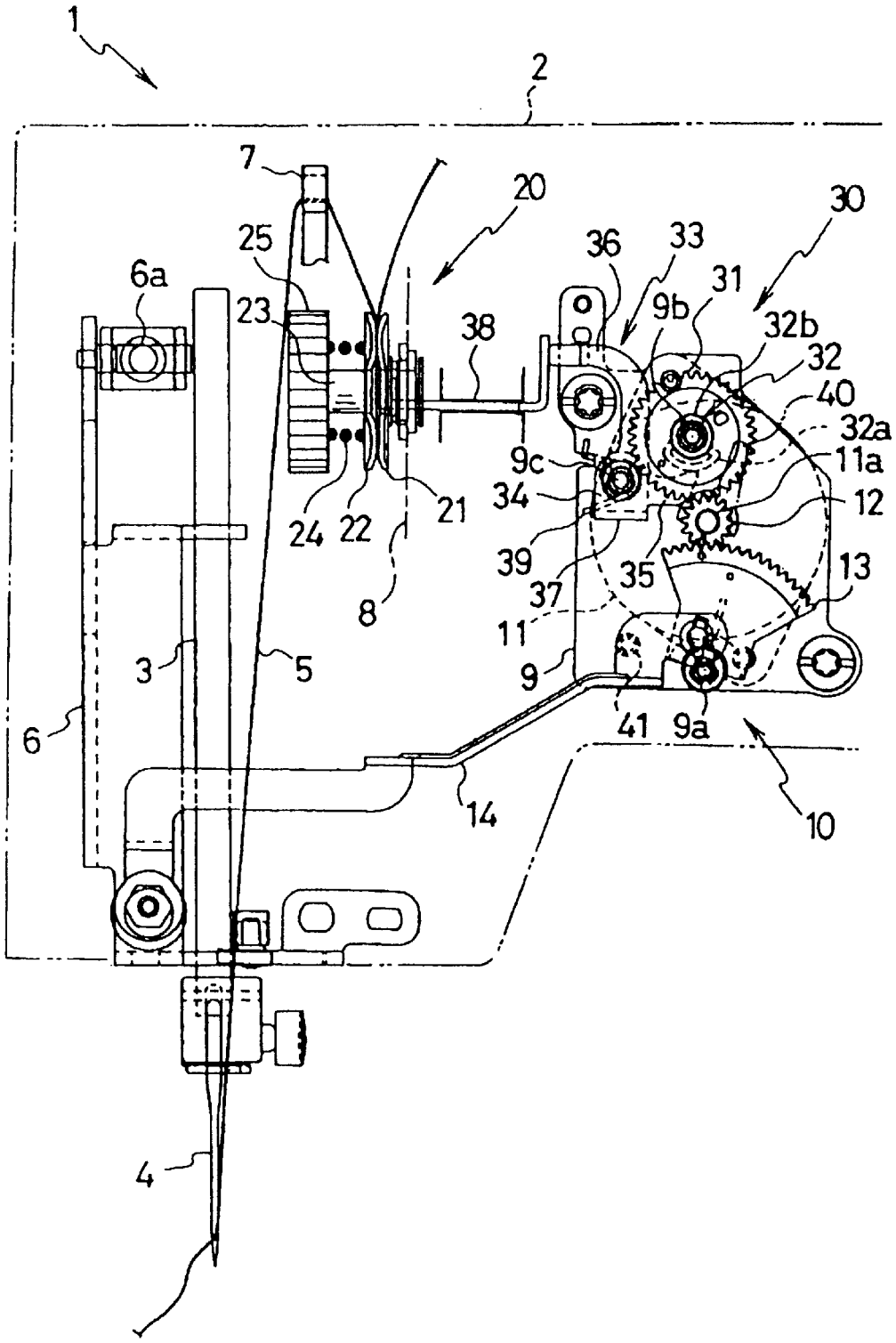
FIG. 2 is a view similar to FIG. 1, showing the needle bar assuming the right-hand needle position.
Figure 3:
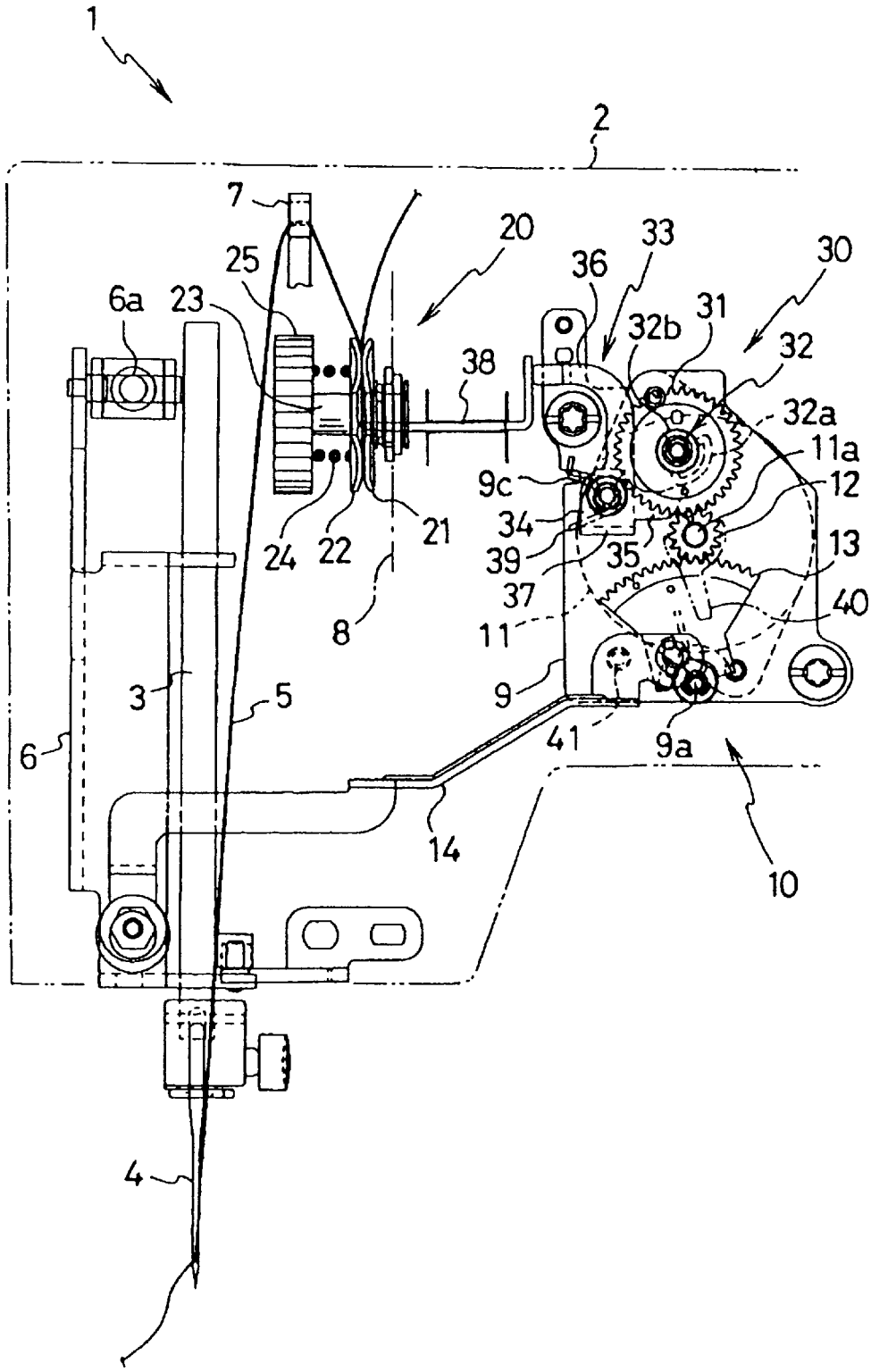
FIG. 3 is a view similar to FIG. 1, showing the needle bar assuming the left-hand needle position.

FIG. 1 shows the needle bar 3 assuming a central needle position at which the needle bar extends vertically. When rocked a predetermined amount rightward from the central needle position, the needle bar 3 assumes a right-hand needle position as shown in FIG. 2. When rocked a predetermined amount leftward from the central needle position, the needle bar 3 assumes a left-hand needle position as shown in FIG. 3. A rocking range of the needle bar rocking mechanism 10 in the sewing is defined between the right-hand needle position in FIG. 2 and the left-hand needle position in FIG. 3. This rocking range is effectuated by an operation range of the stepping motor 11 for rocking the needle bar 3 or a rotational angle range thereof. The stepping motor 11 is thus rotated in the normal and reverse directions within this needle bar rocking operation range, so that the needle bar 3 is rocked in the range between the right-hand needle position in FIG. 2 and the left-hand needle position in FIG. 3. When the needle bar 3 is rocked leftward and rightward within the rocking range, various types of ordinary stitches such as a zigzag stitch are formed on the workpiece cloth being fed forward and backward.

The thread tension applying mechanism 20 will now be described in detail. The thread tension applying mechanism 20 comprises a fixed thread tension disc 21, a movable thread tension disc 22, a shaft member 23, a compression coil spring 24, and a spring force adjusting knob 25. The fixed and movable thread tension discs 21 and 22 are disposed opposite the shaft member 23. The movable thread tension disc 22 is supported to be moved leftward and rightward thereby to come close to and depart from the fixed thread tension disc 21. Furthermore, the movable thread tension disc 22 is urged rightward by the compression coil spring 24. The needle thread 5 supplied from the bobbin to a thread take-up lever 7 is guided to be en route held between the thread tension discs 21 and 22 so that tension is applied to the needle thread 5.

The shaft member 23 projects leftward from a mounting plate 8 provided on a sewing machine frame (not shown). The shaft member 23 extends through holes (not shown) of the fixed and movable thread tension discs 21 and 22. The knob 25 for adjusting the spring force of the compression coil spring 24 is secured to the left-hand end of the shaft member 23. The compression coil spring 24 is disposed around the shaft member 23 between the movable thread tension disc 22 and the knob 25. The shaft member 23 is screwed into the mounting plate 8 so that the spring force adjusting knob 25 is turned to vary a space between it and the movable thread tension disc 22 or the mounting plate 8. As a result, the spring force applied to the movable thread tension disc 22 and accordingly, the tension applied to the needle thread 5 or stitch balancing thread tension can be adjusted.

The thread tension releasing mechanism 30 will be described in detail. The stepping motor 11 of the needle bar rocking mechanism 10 also serves as an actuator for the thread tension releasing mechanism 30. Thus, both the needle bar rocking mechanism 10 and the thread tension releasing mechanism 30 are actuated by the common actuator. A driven gear 31 is meshed with the driving gear 12 secured to the output shaft 11*a* of the stepping motor 11. The driven gear 31 is rotatably mounted on a shaft 9*b* projecting forward from the board 9. A cam 32 is provided to be coaxial with the driven gear 31. A rocking lever 33 abutting and accordingly driven by the cam 32 is rotatably mounted on a shaft 9*c* projecting forward from the board 9. An operating member 38 operated by a driving force of the rocking lever 33 is provided to be moved leftward and rightward. When moved leftward, the operating member 38 pushes the movable thread tension disc 22 of the thread tension applying mechanism 20 leftward.

The rocking lever 33 is disposed between the board 9 and the driven gear 32. The rocking lever 33 includes a pivoted portion 34 rotatably mounted on the shaft 9*c,* a first lever portion 35 extending from the pivoted portion 34 toward the cam 32, a second lever portion 36 extending upward from the pivoted portion 34 and bent leftward, and a spring receiving portion 37 provided below the pivoted portion 34. A torsion coil spring 39 is wound on the shaft 9*c*. One of two ends of the torsion coil spring 39 is engaged with the board 9 and the other end thereof is engaged with the spring receiving portion 37 of the rocking lever 33. The rocking lever 33 is urged by a spring force of the torsion coil spring 39 so as to be rotated counterclockwise about the shaft 9*c*.

The cam 32 includes a large diameter portion 32*a* formed in the range of 120 degrees and a small diameter portion 32*b*. When the rocking lever 33 is urged counterclockwise by the torsion coil spring 39, the first lever portion 35 thereof abuts the large diameter portion 32*a* or the small diameter portion 32*b* of the cam 32. In the needle bar rocking operation range of the stepping motor 11 as shown in FIGS. 1 to 3, the first lever portion 35 abuts the large diameter portion 32*a*. Upon abutment of the first lever portion 35 against the large diameter portion 32*a,* the rocking lever 33 is not allowed to rock even if the stepping motor 11 is operated. Accordingly, since the driving force is not transmitted from the rocking lever 33 to the operating member 38, the paired thread tension discs 21 and 22 are maintained in the closed state.

Figure 5:
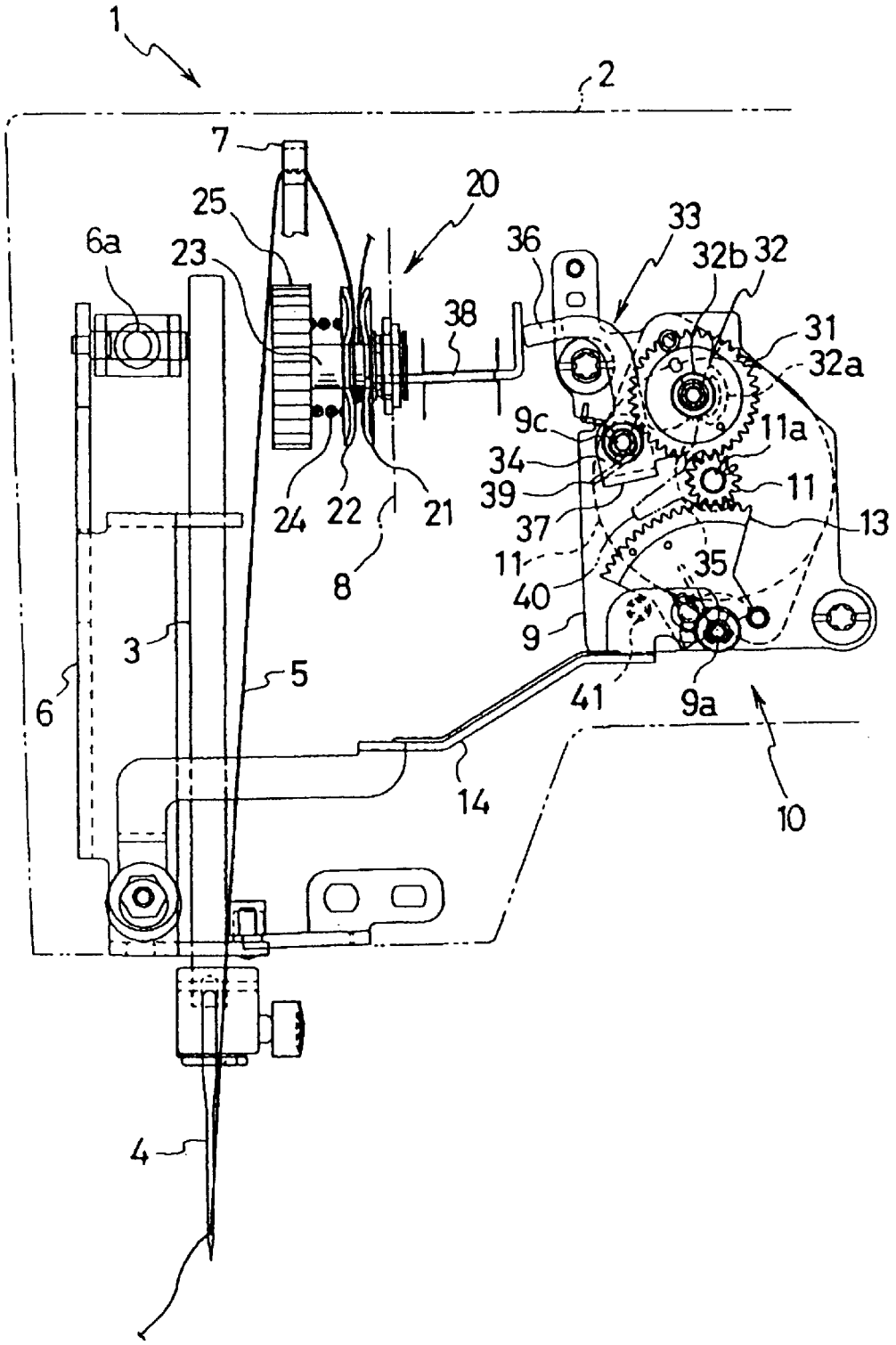
FIG. 5 is a view similar to FIG. 1, showing the thread tension applying mechanism in the released state.

The operation of the thread tension releasing mechanism 30 will now be described in the case where the thread tension discs 21 and 22 of the thread tension applying mechanism 20 are opened as shown in FIG. 5. The stepping motor 11 is rotated so that the rotational position thereof is outside the needle bar rocking operation range. Then, the first lever portion 35 of the rocking lever 33 abuts the small diameter portion 32*b* of the cam 32, namely, the needle bar 3 is rocked to the left of the left-hand needle position in FIG. 3. As a result, the thread tension discs 21 and 22 of the thread tension applying mechanism 20 are opened. More specifically, when the stepping motor 11 is rotated in the state as shown in FIG. 3, the driven gear 31 is rotated counterclockwise so that the first lever portion 35 of the rocking lever 33 abuts the small diameter portion 32*b* of the cam 32. The urging force of the torsion coil spring 39 rotates the rocking lever 33 counter-clockwise. The operating member 38 receives the urging force at an input portion 38*a* (see FIG. 4) thereby to move leftward. Then, the movable thread tension disc 22 of the thread tension applying mechanism 20 is pushed leftward by an output portion 38*b* (see FIG. 4) of the operating member 38 against the urging force of the compression coil spring 24. Consequently, the movable thread tension disc 22 is caused to depart from the fixed thread tension disc 21 as shown in FIG. 5, or the thread tension discs 21 and 22 are opened.

In the above-described construction, a stopper pin 41 projects from the board 9 on the left of the shaft 9*c*. When the thread tension releasing mechanism 30 is operated so that the needle thread discs 21 and 22 are opened as described above, the driving gear 12 and accordingly the stepping motor 11 are rotated until the left-hand end of the sector gear 13 abuts the stopper pin 41 as shown in FIG. 5.

The sewing machine 1 is provided with a thread tension releasing switch (not shown). When the thread tension releasing switch is operated by the user, the thread tension releasing mechanism 30 drives the thread tension applying mechanism 20 to open the thread tension discs 21 and 22. More specifically, the thread tension releasing switch is operated when the thread is caused to pass through the needle eye or when the workpiece cloth is manually moved a large amount in the cloth feeding direction or another direction. In response to a switch signal delivered from the thread tension releasing switch, a control device (not shown) of the sewing machine controls the stepping motor 11 so that the thread tension releasing mechanism 30 is operated to open the thread tension discs 21 and 22 of the thread tension applying mechanism 20 in the manner as described above. When the workpiece cloth is moved a large amount during the sewing, the control device preferably controls the thread tension releasing mechanism 30 so that the latter is operated to open the discs 21 and 22 of the mechanism 20 on the basis of sewing data set in the sewing machine.

Figure 6:
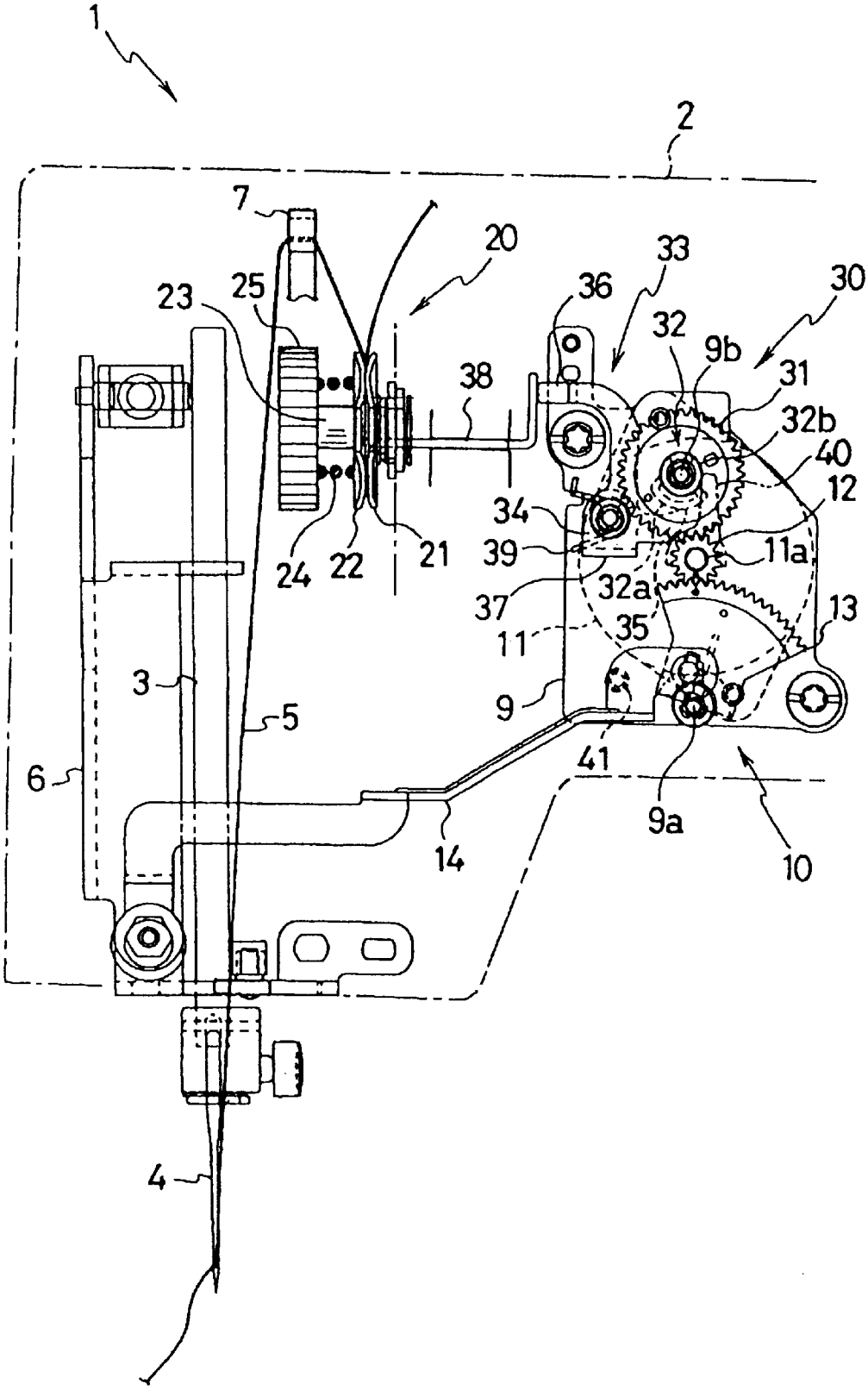
FIG. 6 is a view similar to FIG. 1, showing the initial state of a stepping motor.

The driving gear 12 has a lever-shaped stopper 40 integrally formed in the front end thereof. The stopper 40 is used for the setting of a home position of the stepping motor 11 when the machine is connected to a power supply or when the sewing is started. The setting of the home position will be described. For example, when the sewing is started, the stepping motor 11 is rotated so that the rotational position thereof is shifted outside the needle bar rocking operation range to the range at the side opposed to the range in which the thread tension releasing mechanism 30 is operated to open the thread tension discs 21 and 22 of the thread tension applying mechanism 20, whereby the needle bar 3 is rocked rightward from the right-hand needle position as shown in FIG. 2. As a result, the stopper 40 of the driving gear 12 abuts the shaft 9*b* of the cam 32 or a cylindrical portion integrally formed on the driven gear 31. The rotational position at which the stopper 40 abuts the shaft 9*b* is an initial rotational position or home position. The home position of the stepping motor 11 is set in the initial state where the stopper 40 is in abutment against the shaft 9*b*. Thus, in the initial state as shown in FIG. 6, the first lever portion 35 of the rocking lever 33 is in abutment against the large diameter portion 32*a* of the cam 32 such that the thread tension applying mechanism 20 is disallowed to operate so that the thread tension discs 21 and 22 are opened.

According to the above-described sewing machine, the single stepping motor 11 serves both as the actuator for the needle bar rocking mechanism 10 and as the actuator for the thread tension applying mechanism 20. Consequently, the manufacturing cost of the sewing machine can be reduced to a large extent, and the size of the head 2 can be reduced. Furthermore, when the thread tension releasing mechanism 30 is operated to open the thread tension discs 21 and 22 of the thread tension applying mechanism 20, the stepping motor 11 is rotated so that the rotational position thereof is shifted outside the needle bar rocking operation range. Thus, only the needle bar rocking mechanism 10 can be operated and the thread tension releasing mechanism 30 is disallowed to be operated in the needle bar rocking operation range of the stepping motor 11. The thread tension releasing mechanism 30 is allowed to operate only when the rotational position of the motor is outside the needle bar rocking operation range.

The thread tension releasing mechanism 30 comprises the driving gear 12, the driven gear 31, the cam 32, the rocking lever 33, and the operating member 38. Consequently, the thread tension releasing mechanism 30 can reliably be operated when the rotational position of the motor is outside the needle bar rocking range. Furthermore, since the construction of the thread tension releasing mechanism 30 is simplified, the manufacturing cost of the sewing machine can further be reduced. Additionally, the stopper 40 integrally formed on the driving gear 12 is caused to abut the shaft 9*b* of the cam 40 so that the home position of the stepping motor 11 is set. Thus, the home position of the stepping motor 11 can readily be set.

The stepping motor 11 is rotated so as to assume the rotational position shifted into the operation range at one side of and outside the needle bar rocking operation range when the home position thereof is set. The stepping motor 11 is rotated so as to assume the rotational position shifted into the operation range at the other side of and outside the needle bar rocking operation range when the thread tension releasing mechanism 30 is operated to open the thread tension discs 21 and 22 of the thread tension applying mechanism 20. Thus, the setting of the home position of the stepping motor 11 and the operation of the thread tension releasing mechanism 30 can be executed independently of each other. It is preferable that the thread tension releasing mechanism 30 should be operated to open the thread tension discs 21 and 22 of the thread tension mechanism 20 when the workpiece cloth is moved a predetermined amount or more. Consequently, stitches formed on the workpiece cloth can be prevented from being excessively shrunk and the thread can reliably be prevented from being cut off.

Modified forms of the first embodiment will be described. First, a discrete stopper member may be secured to the driving gear 12 instead of the stopper 40 integrally formed on the driving gear. Furthermore, the operating member 38 of the thread tension releasing mechanism 30 may be eliminated. Furthermore, the second lever portion 36 of the rocking lever may be extended leftward so that the extended distal end directly pushes the movable thread tension disc 22, instead. Furthermore, the rocking lever 33 may be urged clockwise, and the rocking lever 33 may be rocked counterclockwise against the urging force, following the cam 32, so that the driving force is transmitted to the operating member 38. Furthermore, a tension sensor may be provided for detecting the tension of the portion of the needle thread 5 between the thread tension discs 21, 22 and the sewing needle 4. Based on the tension of the needle thread 5 detected by the tension sensor, the thread tension releasing mechanism 30 may be operated to open the thread tension discs 21 and 22 of the thread tension applying mechanism 20. Additionally, although the can 32 is coaxial with the driven gear 31 in the foregoing embodiment, the driven gear 31 may be eliminated and the cam 32 may be disposed to be coaxial with the driving gear 12, instead. This construction can further decrease the number of parts and reduce the overall size of the sewing machine.

Figure 7:
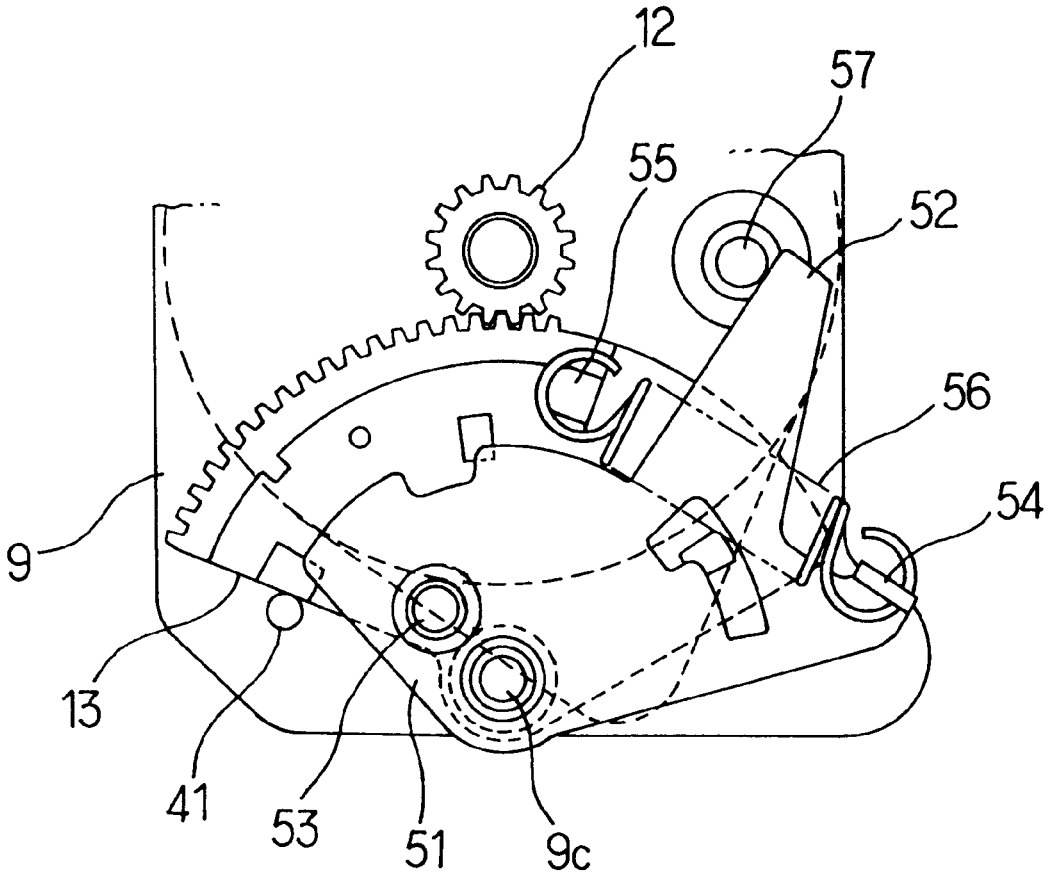
FIG. 7 is a partial front view of the stepping motor employed in the sewing machine of a second embodiment in accordance with the present invention and its peripheral parts when the needle bar assumes the central needle position.
Figure 8:
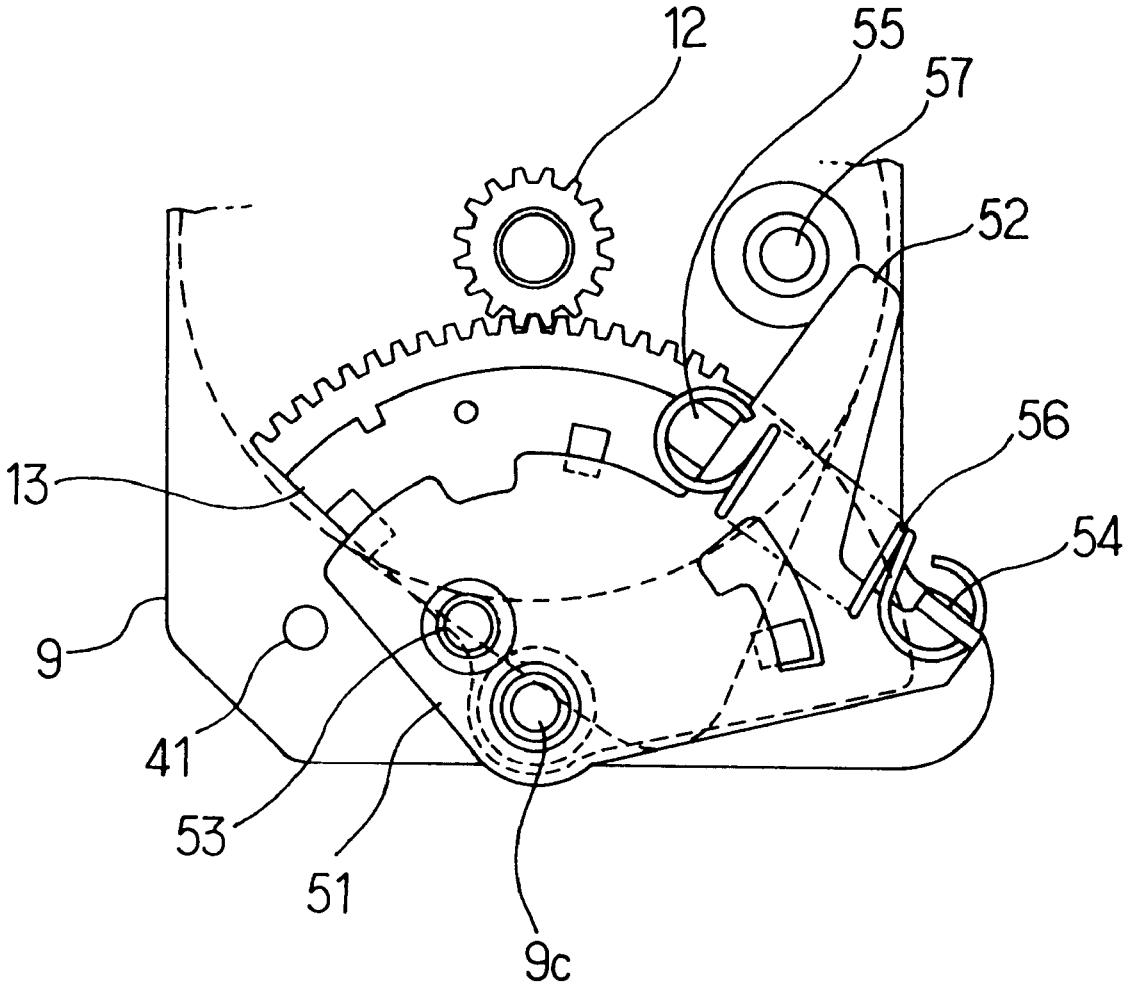
FIG. 8 is a view similar to FIG. 7, showing the needle bar assuming the left-hand needle position.
Figure 9:
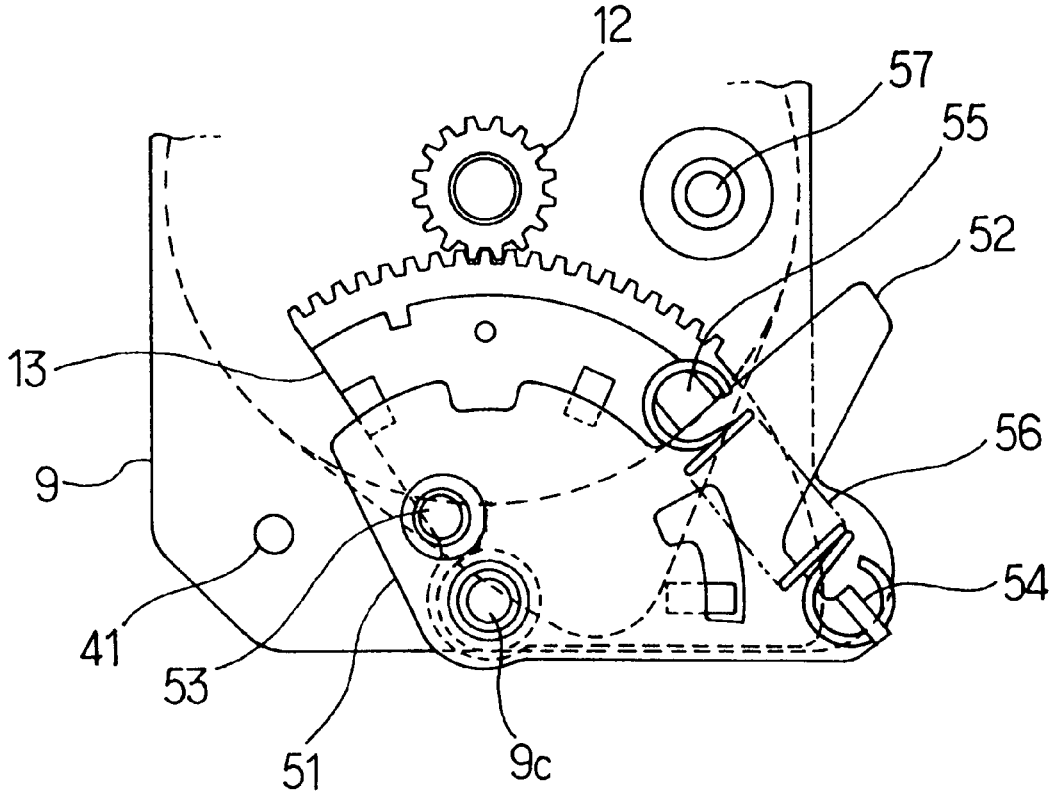
FIG. 9 is a view similar to FIG. 7, showing the thread tension applying mechanism in the released state.

FIGS. 7 to 9 illustrate a second embodiment of the invention. Only the differences between the first and second embodiments will be described. The identical or similar parts in the second embodiment are labeled by the same reference symbols as in the first embodiment. In the second embodiment, the needle bar 3 is not moved leftward beyond the left-hand needle position (see FIG. 3) when the thread tension releasing mechanism 30 is operated to open the thread tension discs 21 and 22 of the thread tension applying mechanism 20. More specifically, as shown in FIG. 7, a rotatable plate 51 is provided between the sector gear 13 and one end of the connecting member 14 which is not shown in FIG. 7. The rotatable plate 51 is rotatably mounted on the shaft 9*a* so as to overlap the front face of the sector gear 13. The rotatable plate 51 is formed of a generally sectorial metal plate and includes a rotation limiting portion 52 provided on the right-hand end thereof.

One end (not shown in FIG. 7) of the connecting member 14 is rotatably connected to a shaft 53 provided on the rotatable plate 51 to be located slightly over the shaft 9*a*. The rotatable plate 51 has a spring hook 54 formed on the right-hand end thereof, and the sector gear 13 also has a spring hook 55 formed on the peripheral edge thereof. An extension coil spring 56 is hung on the spring hooks 54 and 55. The rotatable plate 51 and the sector gear 13 are usually rotated together in the rocking range of the needle bar 3 or the needle bar rocking operation range of the motor 11. For example, FIG. 7 shows the rotatable plate 51 and the sector gear 13 assuming the central needle position. FIG. 8 shows the rotatable plate 51 and the sector gear 13 moved by the stepping motor 11 from the central needle position to the left-hand needle position.

The operation of the thread tension releasing mechanism 30 in the second embodiment will now be described. The stepping motor 11 is rotated in the state of FIG. 8 in which the motor assumes the left-hand needle position, so that departing from the large diameter portion 32*a* of the cam 32, the first lever portion 35 of the rocking lever 33 abuts the small diameter portion 32*b* in the same manner as in the first embodiment. Upon the abutment of the first lever portion 35 against the small diameter portion 32*b*, the rocking lever 33 is rotated counterclockwise against the urging force of the torsion coil spring 39 so that the operating member 38 is moved leftward. Consequently, the movable thread tension disc 22 is moved to depart from the fixed thread tension disc 21 as shown in FIG. 5. In this regard, the rotatable plate 51 and the sector gear 13 are operated as follows. When the rotatable plate 51 and the sector gear 13 are rotated counterclockwise from the central needle position in FIG. 8, the rotation limiting portion 52 of the rotatable plate 51 immediately abuts a shaft 57 projecting forward from the board 9 as shown in FIG. 9. The rotation of the rotatable plate 51 is then stopped, and the movement of the connecting member 14 and the rocking of the needle bar 3 are accordingly stopped. However, the sector gear 13 continues to rotate counterclockwise against the spring force of the expansion coil spring 56. The rotation of the sector gear 13 is stopped when the left-hand end thereof abuts the stopper pin 41. Thus, the needle bar 3 is not moved leftward beyond the left-hand needle position when the thread tension releasing mechanism 30 is operated to open the thread tension discs 21 and 22 of the thread tension applying mechanism 20.

The other construction of the sewing machine in the second embodiment is the same as that in the first embodiment. Accordingly, substantially the same effect can be achieved in the second embodiment as in the first embodiment. Particularly in the second embodiment, the needle bar 3 is not moved leftward beyond the left-hand needle position when the thread tension releasing mechanism 30 is operated to open the thread tension discs 21 and 22 of the thread tension applying mechanism 20. Accordingly, when the thread tension releasing mechanism 30 is operated to open the thread tension discs 21 and 22 of the thread tension applying mechanism 20, the needle bar 3 remains at the left-hand needle position even if a pulley of a main shaft of the sewing machine is manually rotated by the user, namely, even if the sewing machine is operated so that the needle bar 3 is lowered. Consequently, the sewing needle 4 can be prevented from colliding against a throat plate (not shown). The above-described modified forms of the first embodiment are applied to the second embodiment.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A sewing machine comprising:

a needle bar rocking mechanism for rocking a needle bar in a direction crossing a direction in which a workpiece cloth to be sewn is fed;

a thread tension applying mechanism for applying tension to a needle thread supplied from a needle thread supply to a sewing needle mounted on the needle bar;

a thread tension releasing mechanism operating the thread tension applying mechanism so that the needle thread is released from the tension applied thereto by the thread tension applying mechanism; and a single rotary actuator for driving both of the needle bar rocking mechanism and the thread tension releasing mechanism.

2. A sewing machine according to claim 1, wherein the rotary actuator is operated in a set range of needle bar rocking operation when operated to drive the needle bar rocking mechanism, and when operated outside the set range of needle bar rocking, the rotary actuator drives the thread tension releasing mechanism so that the thread tension applying mechanism is operated to release the needle thread from the tension.

3. A sewing machine according to claim 2, wherein when the workpiece cloth is moved a predetermined amount or more, the thread tension releasing mechanism is driven to operate the thread tension applying mechanism so that the needle thread is released from the tension applied thereto by the thread tension applying mechanism.

4. A sewing machine according to claim 2, wherein the thread tension applying mechanism includes a fixed thread tension disc and a movable thread tension disc moved to come close to and depart from the fixed thread tension disc, and the thread tension releasing mechanism includes a driving gear secured to an output shaft of the rotary actuator, a driven gear meshed with the driving gear, a cam provided in a coaxial relation with the driven gear, a rocking lever driven following the cam, and an operating member operated in subjection to a driving force of the rocking lever to thereby move the movable thread tension disc of the thread tension applying mechanism so that the movable thread tension disc departs from the fixed thread tension disc, thereby releasing the needle thread from the tension applied thereto by the thread tension applying mechanism.

5. A sewing machine according to claim 4, wherein when the workpiece cloth is moved a predetermined amount or more, the thread tension releasing mechanism is driven to operate the thread tension applying mechanism so that the needle thread is released from the tension applied thereto by the thread tension applying mechanism.

6. A sewing machine according to claim 4, wherein the rotary actuator comprises a stepping motor, and the driven gear has a stopper member formed integrally therewith, the stopper member being abutted against a stationary member of the machine so that a home position of the stepping motor is set.

7. A sewing machine according to claim 6, wherein the stepping motor is rotated so that a rotational position thereof is in one of two ranges at opposite sides of and outside the set range of needle bar rocking operation, whereby the home position of the stepping motor is set, and the stepping motor is rotated so that the rotational position thereof is in the other range outside the set range of needle bar rocking operation, whereby the thread tension releasing mechanism is driven to operate the thread tension applying mechanism so that the needle thread is released from the tension applied thereto by the thread tension applying mechanism.

8. A sewing machine according to claim 7, wherein when the workpiece cloth is moved a predetermined amount or more, the thread tension releasing mechanism is driven to operate the thread tension applying mechanism so that the needle thread is released from the tension applied thereto by the thread tension applying mechanism.

9. A sewing machine according to claim 6, wherein when the workpiece cloth is moved a predetermined amount or more, the thread tension releasing mechanism is driven to operate the thread tension applying mechanism so that the needle thread is released from the tension applied thereto by the thread tension applying mechanism.

10. A sewing machine according to claim 6, wherein the stationary member is a shaft on which the cam is rotatably mounted.

11. A sewing machine according to claim 10, wherein when the workpiece cloth is moved a predetermined amount or more, the thread tension releasing mechanism is driven to operate the thread tension applying mechanism so that the needle thread is released from the tension applied thereto by the thread tension applying mechanism.

12. A sewing machine according to claim 10, wherein the stepping motor is rotated so that a rotational position thereof is in one of two ranges at opposite sides of and outside the set range of needle bar rocking operation, whereby the home position of the stepping motor is set, and the stepping motor is rotated so that the rotational position thereof is in the other range outside the set range of needle bar rocking operation, whereby the thread tension releasing mechanism is driven to operate the thread tension applying mechanism so that the needle thread is released from the tension applied thereto by the thread tension applying mechanism.

13. A sewing machine according to claim 12, wherein when the workpiece cloth is moved a predetermined amount or more, the thread tension releasing mechanism is driven to operate the thread tension applying mechanism so that the needle thread is released from the tension applied thereto by the thread tension applying mechanism.

14. A sewing machine according to claim 1, wherein when the workpiece cloth is moved a predetermined amount or more, the thread tension releasing mechanism is driven to operate the thread tension applying mechanism so that the needle thread is released from the tension applied thereto by the thread tension applying mechanism.

15. A sewing machine comprising:

needle bar rocking means for rocking a needle bar in a direction crossing a direction in which a workpiece cloth to be sewn is fed;

thread tension applying means for applying tension to a needle thread supplied from a needle thread supply to a sewing needle mounted on the needle bar;

thread tension releasing means operating the thread tension applying mechanism so that the needle thread is released from the tension applied thereto by the thread tension applying mechanism; and a single rotary actuator for driving both of the needle bar rocking means and the thread tension releasing means.

16. A sewing machine according to claim 15, wherein when the workpiece cloth is moved a predetermined amount or more, the thread tension releasing means is driven to operate the thread tension applying means so that the needle thread is released from the tension applied thereto by the thread tension applying means.

17. A sewing machine according to claim 15, wherein the rotary actuator is operated in a set range of needle bar rocking operation when operated to drive the needle bar rocking means, and when operated outside the set range of needle bar rocking, the rotary actuator drives the thread tension releasing means so that the thread tension applying means is operated to release the needle thread from the tension.

18. A sewing machine according to claim 17, wherein when the workpiece cloth is moved a predetermined amount or more, the thread tension releasing means is driven to operate the thread tension applying means so that the needle thread is released from the tension applied thereto by the thread tension applying means.

19. A sewing machine according to claim 17, wherein the thread tension applying means includes a fixed thread tension disc and a movable thread tension disc moved to come close to and depart from the fixed thread tension disc, and the thread tension releasing means includes a driving gear secured to an output shaft of the rotary actuator, a driven gear meshed with the driving gear, a cam provided in a coaxial relation with the driven gear, a rocking lever driven following the cam, and an operating member operated in subjection to a driving force of the rocking lever to thereby move the movable thread tension disc of the thread tension applying means so that the movable thread tension disc departs from the fixed thread tension disc, thereby releasing the needle thread from the tension applied thereto by the thread tension applying means.

20. A sewing machine according to claim 19, wherein when the workpiece cloth is moved a predetermined amount or more, the thread tension releasing means is driven to operate the thread tension applying means so that the needle thread is released from the tension applied thereto by the thread tension applying means.

* * * * *